US005205220A

United States Patent [19]

Wallace

[11] Patent Number: 5,205,220

[45] Date of Patent: Apr. 27, 1993

[54] RAILWAY TRUCK

[76] Inventor: Brooks Wallace, 921 Coosa St., Birmingham, Ala. 35222

[21] Appl. No.: 895,126

[22] Filed: Jun. 8, 1992

[51] Int. Cl.[5] ..... B61F 5/00

[52] U.S. Cl. ..... 105/167; 105/138; 105/133; 105/206.1; 105/136; 105/101

[58] Field of Search ..... 105/165, 167, 168, 157.1, 105/101, 159, 171, 182,1, 185, 199.4, 96.1, 99, 101, 102, 133, 138, 136, 179, 206.1, 209

[56] References Cited

U.S. PATENT DOCUMENTS

| | | | |
|---|---|---|---|
| 4,537,138 | 8/1985 | Bullock | 105/168 |
| 4,679,507 | 7/1987 | Rassaian | 105/168 |
| 4,787,318 | 11/1988 | Vogel | 105/167 |
| 5,086,706 | 2/1992 | Boivin | 105/168 |

*Primary Examiner*—Mark T. Le
*Attorney, Agent, or Firm*—Jennings, Carter, Thompson & Veal

[57] ABSTRACT

An improvement in railway trucks having a flexible frame and independent drive mechanism particularly adapted to accommodate the flexing frame. The frame includes parallel first and second frame members, a first cross-member rigidly attached to the first frame member and loosely attached to the second frame member. A second cross-member is rigidly connected to the second frame member and loosely engaged by the first frame member. Hydraulic motors are pivotally connected to the second cross-member by pivotal arms and pivotally secured to a pair of rail way truck axles supporting the frame members such that flexion of the frames and cross-members will not affect the distance between the motor and the axles. Chain and sprocket assemblies are provided to operatively connect the motors and the axles. An engine and hydraulic pumps are connected to the first cross-member to drive the motors. The pumps are operatively connected to the motors with flexible conduit. The flexible conduit is particularly effective in accommodating relative movement between the motors and the pumps caused by the relative deflection between the various cross-members and frame members.

11 Claims, 3 Drawing Sheets

RAILWAY TRUCK

FIELD OF THE INVENTION

The present invention relates to railway trucks and, more particularly, to railway trucks for transporting highway vehicles on a railway. In even greater particularity, the present invention relates to self-driven railway trucks for transporting highway vehicles on a railway.

BACKGROUND OF THE INVENTION

Typical railway cars usually include at least two railway trucks at either end thereof. The railway truck consist of a rigid frame having a pair of axles rotatably connected thereto and supported by wheels. The railway trucks are pivotally connected to the rail car supported thereby to accommodate turns in the railway; however, derailments sometimes occur in a turn when the spacing between the rails is not consistent and the rigid nature of the railway truck frame forces one or more of the wheels from a supporting rail.

A more specialized use of railway trucks is even more likely to facilitate the derailment situation discussed above. As is shown in U.S. Pat. No. 3,877,390 issued to Wallace, the inventor herein; independent railway trucks are used to transport a highway vehicle, such as a mobile crane, over a railway. Such highway vehicles are not designed for railway travel and are particularly bulky and top-heavy when supported by the relatively small railway trucks shown in Wallace '390. Note also that the frame of a typical railway car is designed to provide stability between the two supporting railway trucks whereas the railway trucks shown in Wallace '390 act relatively independently having only a loose connection with the highway vehicle carried thereby. Further, the railway trucks in Wallace '390 are self-driven which magnifies the independence between the two cars. The aforesaid combination disclosed in Wallace '390, of a top heavy load transported by rigid, independently driven railway trucks, may be susceptible to derailment when negotiating curves or inconsistencies in the railway. What is needed and not known by the inventor to exist in the industry is a self-driven railway truck having a flexible frame and flexible drive assembly connected thereto and in operative connection with the axles and wheels that will accommodate flexion of the frame at various points thereon to safely negotiate curves and inconsistencies in the railway.

SUMMARY OF THE INVENTION

It is the principal object of the present invention to provide a self-driven railway truck having a flexible frame.

In support of the principal object, another object of the present invention is to provide flexible drive assembly, connected to the flexible frame and to the railway truck's axles, for driving the axles while accommodating any inconsistencies in the railway and the flexion of the frame facilitated thereby.

These and other objects and advantages of the present invention are accomplished through the use of a pair of parallel frame members having a first cross-member fixably connected to a first of the frame members in perpendicular relation thereto and loosely coupled to a second of the frame members by pins connected to the second frame member and slidably received through one or more vertically extending apertures in the first cross-member.

A second cross-member is affixed to the second frame member and extends perpendicularly therefrom through a passage extending horizontally through the first frame member. Axles are rotatably connected to the frame members and have wheels for supporting the rail truck on a railway. A vertical receptacle is connected to the second cross-member to receive therein a pin connected to the highway vehicle thus vertically supporting and laterally securing the highway vehicle to the rail truck.

An engine is supported on the first cross-member and is remotely operated to drive one or more hydraulic pumps connected thereto. A plurality of first pivotal arms are each pivotally connected to the second cross-member and one of a plurality of hydraulic motors having a drive shaft rotatably connected thereto. A second pivotal arm is affixed to each of the motors and pivotally connected to each of the axles to support the motors a predetermine distance from the axles. Chain and sprocket assemblies are provided to operatively connect the drive shafts to the axles. The chains will remain tightened against the sprockets and unaffected by the flexion of the frame due to the maintenance of the drive shafts by the second pivotal arms at a consistent distance from the axles. Flexible conduits are connected to the hydraulic pumps and motors such that the hydraulic pumps may circulate a quantity of hydraulic fluid through the motors to drive the axles. The flexible conduits are necessary to accommodate the relative movement between the pumps and motors caused by the flexing frame.

BRIEF DESCRIPTION OF THE DRAWINGS

Apparatus embodying features of the present invention are depicted in the accompanying drawings which form a portion of this disclosure and wherein.

DESCRIPTION OF A PREFERRED EMBODIMENT

Figure 2:
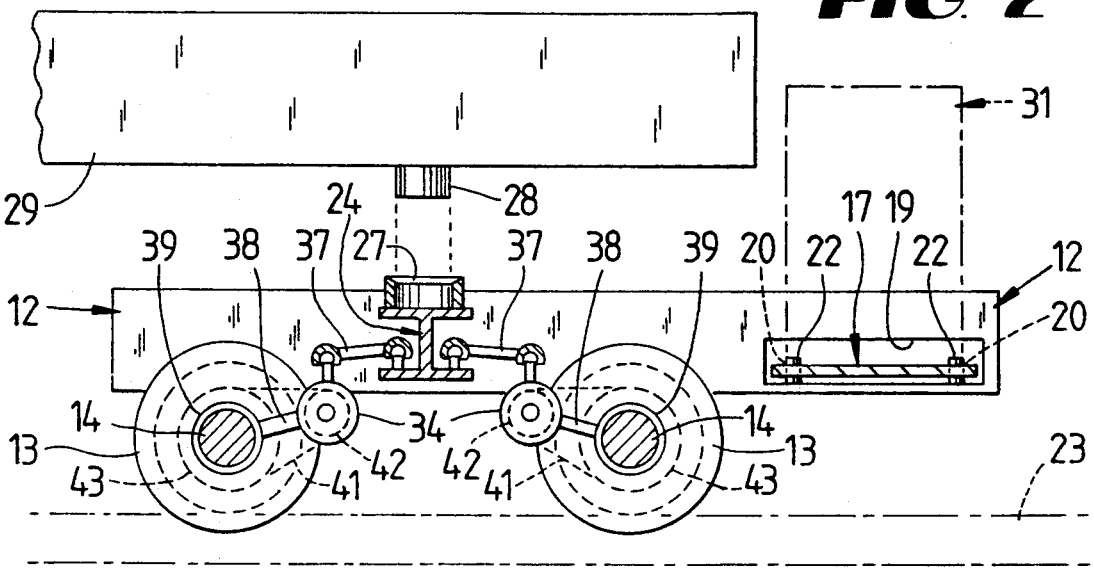
FIG. 2 is a sectional side elevational view of the present invention.
Figure 1:
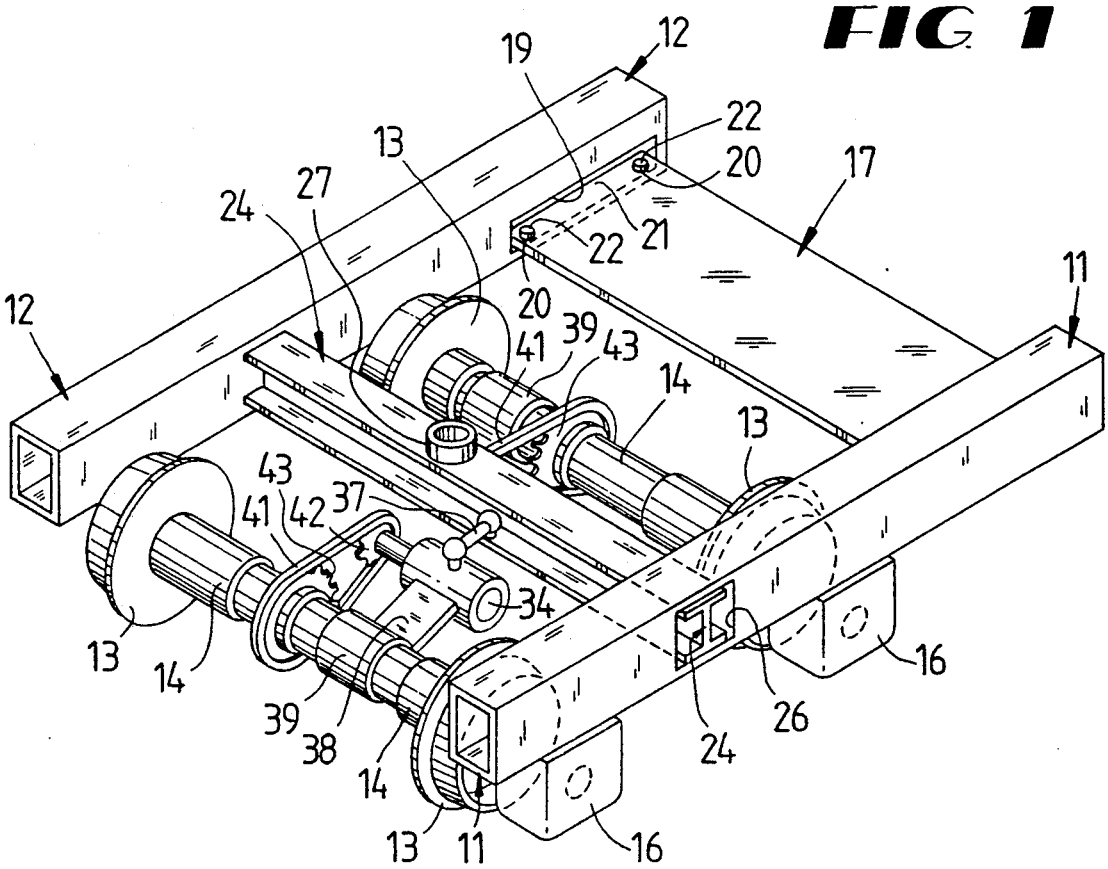
FIG. 1 is a perspective view of the present invention.
Figure 3:
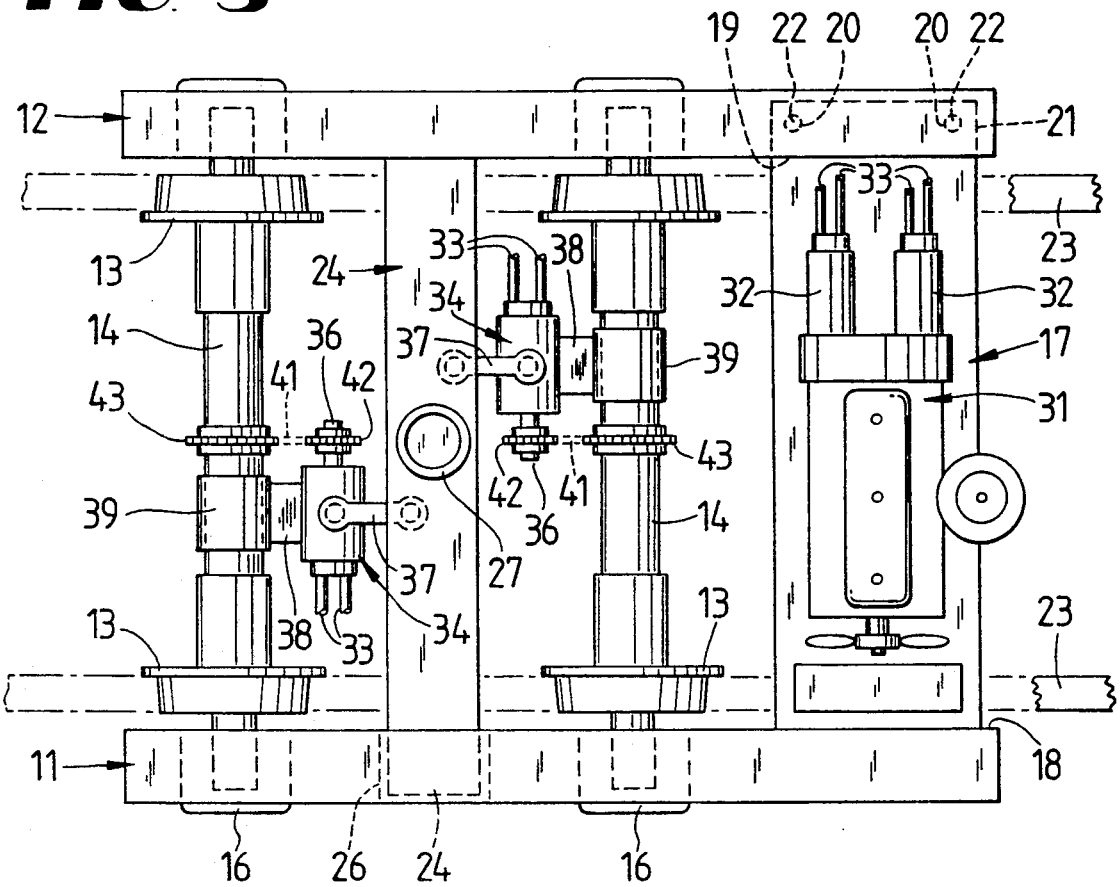
FIG. 3 is a plan view of the present invention.

Referring to the drawings for a clearer understanding of the invention, it should be noted in FIG. 1 that the present invention contemplates the use of parallel first and second frame members 11 and 12 having railway wheels 13 and axles 14 rotably mounted thereto by journals 16. An engine platform or first cross-member 17 is affixed to a forward end 18 of the first frame member 11 and extends perpendicularly therefrom within a horizontally extending recess 19 defined in the second frame member 12. As shown in FIGS. 2 and 3, the first cross-member 17 has one or more apertures 20 extending vertically therethrough at an end 21 distal the first frame member 11. One or more pins 22, connected to the second frame member 12, are slidably received in the apertures 20 to loosely couple the first cross-member 17 to the second frame member 12, wherein the second frame member 12 may deflect vertically, relative to the first cross-member 17.

As shown in FIGS. 1–4, a stabilizer beam or second cross-member 24 is affixed to the second frame member 12 about midway thereon and a substantially equal distance from each of the axles 14. The second cross-member 24 extends perpendicularly from the second frame member 12 and is loosely received within a horizontally extending passage 26 defined by the first frame member 11. The second cross-member 24 may thereby deflect vertically and horizontally relative to the first frame member 11.

Figure 4:
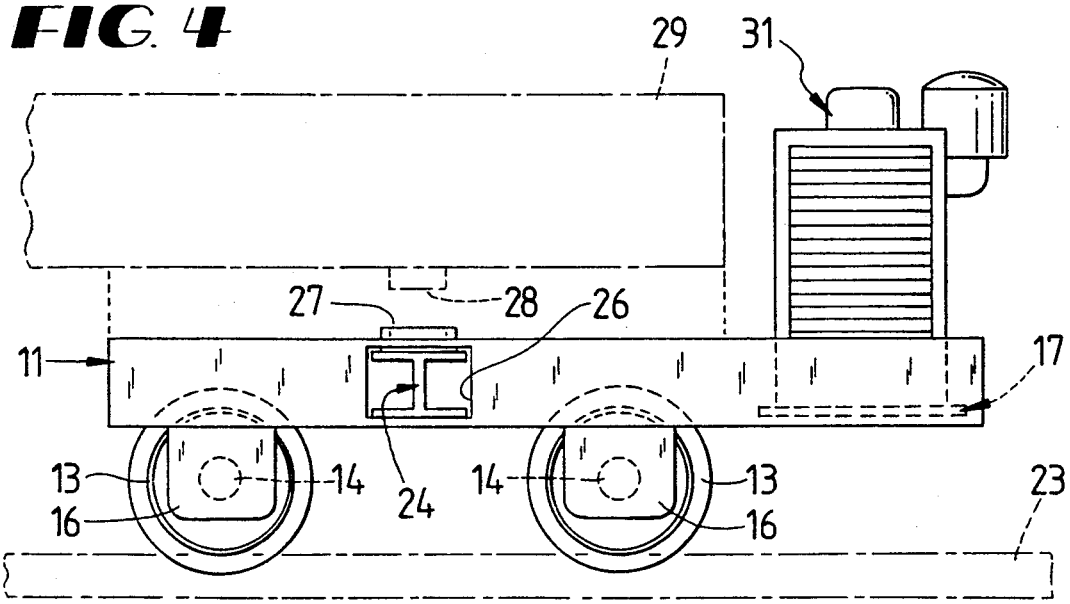
FIG. 4 is a side elevational view of the present invention.
Figure 5:
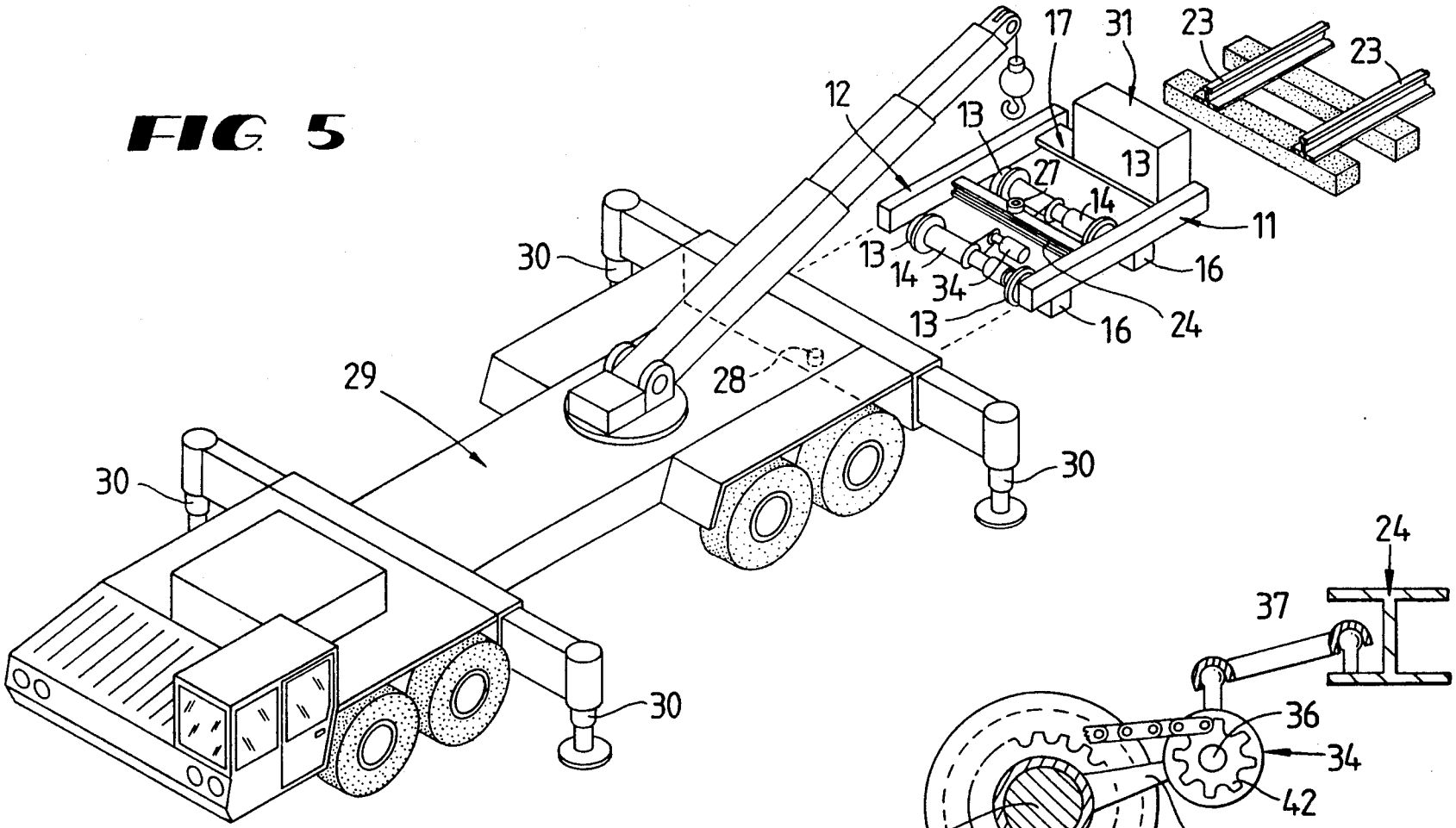
FIG. 5 is a perspective view of the present invention and a highway vehicle.

As shown in FIGS. 2 and 4, a tubular socket or receptacle 27 is integrally connected to the second cross-member 24 and extends axially upwardly therefrom. A pin 28, integrally connected to a highway vehicle 29, is received within the socket 27 and rests on the second cross-member 24 to support the vehicle 29 thereon. The pin 28 is radially engaged by the socket 27 and accommodates pivotal movement of the cross members and frame members relative to the vehicle 29. As shown in FIG. 5, the highway vehicle 29 is driven over the railway and raised on telescopic legs 30 to facilitate placement of the socket 27 beneath the pin 28, whereafter the legs 30 are retracted and the pin 28 is lowered into the socket 27.

As shown in FIG. 3, an engine 31 is connected to and supported by the first cross-member 17 and has a pair of hydraulic pumps 32 operatively connected thereto and driven thereby for circulating a quantity of hydraulic fluid (not shown) through a plurality of flexible conduits 33 connected to the pumps 32. A pair of hydraulic motors 34 are pivotally mounted to the second cross-members 24, as discussed hereinafter, for driving the axles 14 and wheels 13.

Figure 6:
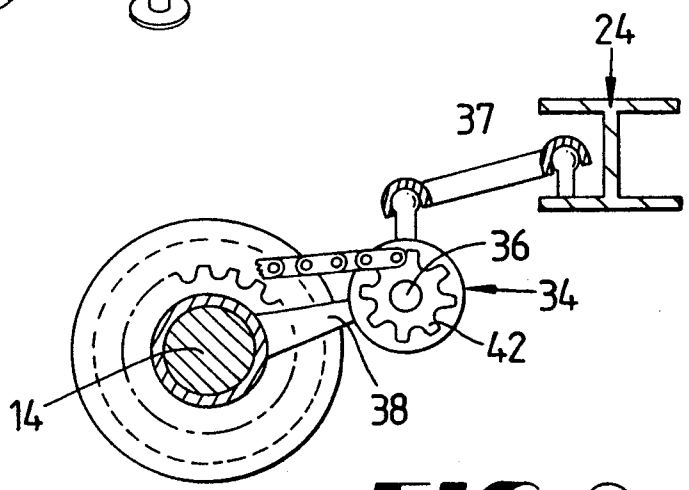
FIG. 6 is a detailed side elevational view of portions of a drive assembly and the axle and wheel driven thereby.

The conduits 33 are connected to motors 34 through which the quantity of hydraulic fluid is circulated to rotate one or more drive shafts 36 rotatably connected to said motors. As shown in FIGS. 1–3, a first pair of pivotal arms 37 are pivotally connected to the second cross-member 24 and are each pivotally connected to one of the motors 34 to support the motors 34 proximal to the axles 14. A second pair of pivotal arms 38 are each rigidly affixed to one of the motors 34 and pivotally mounted to one of the axles 14. As shown in FIG. 6, each second pivotal arm 38 includes a sleeve 39, opposite the motor 34, that receives one of the axles 14 therethrough for rotary movement therein. The second pivotal arms 38 assist the first pivot arms 37 in supporting the motors 34 and space the motors 34 a predetermined distance from axles 14. Bearing assemblies (not shown) may be received within the sleeves 39 and about the axles 14 to minimize friction.

Each motor 34 is operatively connected to an associated axle 14 by a chain 41 operatively engaged about a first sprocket 42 connected to drive shaft 36 and a second sprocket 43 connected to the axle 14. Though the motors 34 may move about the axles 14, the chains 41 are continuously maintained in tightened engagement with the sprockets 42 and 43 by the second pivotal arms 38. It should be readily recognized that belts and pulleys may be used in the alternative as means for operatively connecting the motors and axles. It should also be apparent that the first and second pivotal arms would be equally necessary to maintain the motors a predetermined distance from the axles to maintain the belts in operative engagement with the pulleys while allowing the motors to move relative to the flexing frame members and cross-members.

In operation, the cross-members 17 and 24 and frame members 11 and 12 flex both horizontally and vertically to accommodate inconsistencies in rail spacing while adapting to balance the bulky and particularly top heavy vehicle 29. The pivotal arms 37 and 38 support the motors 34 such the flexion of the cross-members and frame members will not effect the spacing between the motors 34 and the axles 14, thus insuring that the chains 41 will remain in tight, operative engagement with the sprockets 42 and 43. The use of hydraulics, particularly the flexible conduits 33, allow the engine 31 to drive the motors 34 while accommodating the flexion between the cross-members and the frame members and the relative movement between the engine and the motors. From the foregoing, it should be clear that the present apparatus represents a substantial improvement over the prior art.

While I have shown my invention in one form, it will be obvious to those skilled in the art that it is not so limited but is susceptible of various changes and modifications without departing from the spirit thereof.

What I claim is:

1. An improvement in a railway truck used to transport a vehicle designed for highway use over a railway wherein said railway truck has at least two parallel axles supported by railway wheels and at least two horizontally extended frame members operatively connected to and supported by said axles at opposing ends thereof and in perpendicular relation thereto, said improvement comprising:

(a) at least two cross-members coupled to said frame members by connection means to position said frame members in relatively spaced and parallel relation and to permit flexion between said frame members and said cross-members such that said wheels and axles may move relative to said frame members and said cross-members to conform to and accommodate curves and inconsistencies in the railway;

(b) wherein a first of said cross-members comprise an engine platform affixed to a first of said frame members; said engine platform having at least one aperture extending vertically therethrough at an end thereof distal said first frame member; said aperture slidably receiving a vertical pin connected to a second of said frame members such that said engine platform is displaceably coupled to said second frame member to accommodate vertical deflection thereof relative to said engine platform and said first frame member.

2. An improvement as described in claim 1 wherein a second of said cross-members comprises a stabilizer beam affixed to said second frame member and slidably received in a horizontally extending passage defined by said first frame member in normal relation thereto, such that said first frame member may deflect vertically and horizontally relative to said stabilizing beam and said second frame member.

3. An improvement as defined in claim 1 further comprising a tubular receptacle connected to a selected one of said cross-members and extending upwardly therefrom to axially received a downwardly extending pin connected to said highway vehicle, such that said pin is supported on said selected cross-member and radially secured thereto by said tubular receptacle for pivotal movement about a vertical axis.

4. An improvement in a railway truck used to transport a vehicle designed for highway use over a railway wherein said railway truck has at least two parallel axles supported by railway wheels and at least two horizontally extended frame members operatively connected to and supported by said axles at opposing ends thereof and in perpendicular relation thereto, said improvement comprising at least two cross-members displaceably coupled to said frame members by connection means to position said frame members in relatively spaced and parallel relation and to permit flexion between said frame members and said cross-members such that said wheels and axles may move relative to said frame members and said cross-members to conform to and accommodate curves and inconsistencies in the railway; said improvement further comprising:

(a) flexible drive means pivotally connected to at least one of said cross-members and pivotally connected to at least one of said axles for rotating said axles about a horizontal axis; and (b) engine means connected to one of said cross-members for supplying power to said drive means.

5. An improvement as defined in claim 4 wherein said drive means includes:

(a) a first pivotal arm pivotally connected to said one of said cross-members;

(b) a motor pivotally connected to said first pivotal arms and having a drive shaft rotatably connected thereto for rotation about a horizontal axis parallel to said axles;

(c) a second pivotal arm connected to said motors and having a sleeve opposite thereto, such that said sleeve receives one of said axles therethrough for rotary movement therein, wherein said first and second pivotal arms accommodate deflection of said cross-members relative to said axles while supporting said motor at a predetermined distance from said axles; and (d) a flexible inelastic chain, each extending around and operatively engaging a pair of sprockets connected to said drive shaft and said one of said axles to facilitate concomitant rotary movement of said one axle with said one drive shaft.

6. An improvement in a railway truck for transporting a highway vehicle on a railway comprising:

(a) a flexible frame having a pair of parallel frame members supported by a pair of axles operatively connected thereto and a pair of cross-members displaceably coupled to said frame members by connection means to maintain the structural integrity of said frame while permitting deflection of said frame members and axles relative to said cross-members;

(b) a flexible drive means pivotally connected to one of said cross-members and operatively connected to one of said axles for driving the axle about a horizontal axis while accommodating said deflection of said cross-members relative to said axles and said frame members.

7. An improvement in a railway truck for transporting a highway vehicle on a railway comprising:

(a) a flexible frame having a pair of parallel frame members supported by a pair of axles operatively connected thereto and a pair of cross-members displaceably coupled to said frame members by connection means to maintain the structural integrity of said frame while permitting deflection of said frame members and axles relative to said cross-members; said cross-members further comprising an engine platform affixed to a first of said frame members and having at least one aperture extending vertically therethrough at an end thereof distal said first frame member; said aperture slidably receiving a vertical pin connected to a second of said frame members such that said engine platform is displaceably coupled to said second frame member to accommodate vertical deflection thereof relative to said engine platform and said first frame member; and (b) a flexible drive means pivotally connected to one of said cross-members and operatively connected to one of said axles for driving the axle about á horizontal axis while accommodating said deflection of said cross-members relative to said axles and said frame members.

8. An improvement as described in claim 7 wherein said one of said cross-members comprises a stabilizer beam fixedly connected to said second frame member and slidably received in a horizontally extending passage defined by said first frame member in normal relation thereto, such that said first frame member may deflect vertically and horizontally relative to said stabilizing beam and said second frame member.

9. An improvement in a railway truck, used to transport highway vehicles along a railway, said railway truck having a pair of parallel frame members supported by a pair of railway axles operatively connected thereto and having rail wheels on both ends of each axle, said improvement comprising:

(a) an engine support beam affixed to a first of said frame members and having at least one aperture extending vertically therethrough at an end thereof distal said first frame member, wherein said aperture slidably receives a vertical pin connected to a second of said frame members such that said engine support beam is displaceably coupled to said second frame member to accommodate the vertical deflection thereof relative to said engine support beam and said first frame member; and (b) a stabilizer beam affixed to said second frame member and slidably received in a horizontally extending passage defined by said first frame member in normal relation thereto to accommodate vertical and horizontal deflection of said first frame member relative to said stabilizer beam and said second frame member.

10. An improvement as described in claim 9 further comprising:

(a) an engine having one or more hydraulic pumps operatively connected thereto and driven thereby for circulating a quantity of hydraulic fluid;

(b) a plurality of flexible conduits operatively connected to said hydraulic pumps and through which said quantity of hydraulic fluid is circulated;

(c) one or more hydraulic motors pivotally connected to said stabilizer beam and to one or more of said axles, wherein said flexible conduits are connected to said hydraulic motors such that said hydraulic pumps may circulate said quantity of hydraulic fluid through said hydraulic motors to operatively rotate one or more drive shafts rotatably connected thereto, wherein said flexible conduits and pivotal connection connecting said motors to said stabilizer beam accommodate flexion of said stabilizer beam relative to said hydraulic pumps and said axles.

11. An improvement as described in claim 10 further comprising:

(a) a first pivotal arm pivotally connected to said stabilizer beam and affixed to one of said hydraulic motors for pivotally supporting said hydraulic motor relative to said stabilizer beam;

(b) a second pivotal arm each affixed to said hydraulic motor and having a sheath formed at an end thereof, opposite said motor, through which one of said axles is received for rotary movement therein, wherein said second pivotal arm supports said hydraulic motor and maintains said drive shaft a predetermined distance from said axle; and (c) linkage means connected to said axles and said drive shafts for facilitating the rotation of said axles in concomitant relation to said drive shafts.

* * * * *